United States Patent [19]

Hildebrand

[11] 4,391,607

[45] Jul. 5, 1983

[54] DYEING PROCESS AND PRINTING PROCESS USING REACTIVE DYESTUFFS

[75] Inventor: Dietrich Hildebrand, Odenthal, Fed. Rep. of Germany

[73] Assignee: Bayer Aktiengesellschaft, Leverkusen, Fed. Rep. of Germany

[21] Appl. No.: 276,863

[22] Filed: Jun. 24, 1981

[30] Foreign Application Priority Data

Jul. 17, 1980 [DE] Fed. Rep. of Germany ..... 3027077

[51] Int. Cl.[3] ..... C09B 62/00; D06P 1/38

[52] U.S. Cl. ..... 8/549; 8/532; 8/543; 8/618

[58] Field of Search ..... 8/543, 549, 618

[56] References Cited

U.S. PATENT DOCUMENTS

| | | | |
|---|---|---|---|
| 3,791,787 | 2/1974 | Yamada et al. | 8/576 |
| 4,264,321 | 4/1981 | von der Eltz | 8/543 |
| 4,273,553 | 6/1981 | Harms et al. | 8/549 |
| 4,277,246 | 7/1981 | Lehinant et al. | 8/543 |
| 4,278,436 | 7/1981 | Marschner et al. | 8/532 |
| 4,283,193 | 8/1981 | Hildebrand | 8/543 |
| 4,297,101 | 10/1981 | von der Eltz et al. | 8/543 |

FOREIGN PATENT DOCUMENTS

| | | |
|---|---|---|
| 874642 | 9/1979 | Belgium . |
| 895287 | 3/1972 | Canada . |
| 875364 | 8/1961 | United Kingdom . |

*Primary Examiner*—A. Lionel Clingman

*Attorney, Agent, or Firm*—Sprung, Horn, Kramer & Woods

[57] ABSTRACT

The present invention relates to a new process for dyeing or printing fibre materials with reactive dyestuffs which split off fluoride ions, which is characterized in that neutral or acid dyebaths or printing pastes which contain, in addition to the reactive dyestuff and customary auxiliaries and solvents, one or more organic and/or inorganic calcium compounds are employed.

11 Claims, No Drawings

DYEING PROCESS AND PRINTING PROCESS USING REACTIVE DYESTUFFS

The present invention relates to a new process for dyeing or printing fibre materials with reactive dyestuffs which split off fluoride ions, which is characterised in that neutral or acid dyebaths or printing pastes which contain, in addition to the reactive dyestuff and customary auxiliaries and solvents, one or more organic and/or inorganic calcium compounds are employed.

Possible reactive dyestuffs are organic dyestuffs from the series of the azo, anthraquinone, formazine and phthalocyanine dyestuffs which contain at least one fibre-reactive group which splits off a fluoride ion, such as, for example, the monofluoro-s-triazinyl, fluoropyrimidinyl or tetrafluorocyclobutanyl group.

A large number of reactive dyestuffs having the abovementioned structure have been described in the literature (in this context, see, for example, Belgian Patent Specification No. 703,598, Belgian Patent Specification No. 615,614, Belgian Patent Specification No. 276,728, Belgian Patent Specification No. 716,014, Belgian Patent Specification No. 713,937 and Belgian Patent Specification No. 712,733;

E. Siegel in The Chemistry of Synthetic Dyes, Volume VI, Venkantaraman Academic Press, Inc. New York 1972 pages 1–209).

The reactive dyestuffs in the examples and reactive dyestuffs structurally related to these are particularly preferred.

Possible organic calcium compounds are, for example: calcium salts of carboxylic acids, such as calcium acetate, Ca salts of fatty acids, such as calcium stearate, or calcium salts of hydroxycarboxylic acids, such as calcium lactate, and furthermore calcium salts of alkyl- or aryl-sulphonic acids or of phosphonic acids, as well as calcium salts of polymers containing carboxyl groups, such as calcium alginate.

Possible inorganic calcium compounds are both compounds which are soluble in water and compounds which are sparingly soluble in water. By compounds which are sparingly soluble in water there are to be understood those which have a greater solubility product than calcium fluoride but are not soluble to the extent of more than 1 g/l, such as calcium sulphate.

Examples which may be mentioned of readily soluble calcium compounds are: calcium nitrate, calcium thiosulphate and calcium chloride. The bath can also contain a polyphosphate, preferably hexaphosphates, which form soluble complexes with the calcium ions. 0.1 to 20 g, in particular 0.5 to 10 g, of the calcium compound are employed per 1 l of dye liquor or 1 kg of printing paste.

Possible textile fibres which are suitable for the process according to the invention are, in particular, cellulose fibres and mixtures thereof with polyester fibres, polyamide fibres, polyacrylonitrile fibres and wool, as well as wool and/or polyamide in the absence of cellulose fibres.

The dyeing (or printing) process according to the invention is generally carried out by a procedure in which the dye liquor (or the printing paste) has a pH value of 4 to 7, and the temperature is 20° to 240° C.

The process is suitable for all application conditions for dyeing and printing, that is to say for the exhaustion process from a long liquor in which vats, jet-dyeing units and jigs, and furthermore for continuous processes, for example by the pad-thermofix process at 130°–160° C., by the one-bath, one-stage thermofix-thermosol process at 210°–230° C. for 1 minute, or by the HT-steam process with superheated steam at 180° C. for 1–20 minutes, or by fixing in neutral steam at 100°–103° C. for ½–12 minutes.

As regards the individual variants, the following should be stated:

The exhaustion process is preferably carried out in the presence of 10 to 200 g of sodium chloride or sodium sulphate/l of dye liquor.

The pad-thermofix process is preferably carried out in the presence of 0 to 40 g of dicyandiamide and/or 0 to 200 g of urea/l of padding liquor.

The pad-steam process is likewise preferably carried out in the presence of 0 to 200 g of urea/l of padding solution.

If appropriate, printing is carried out directly in the presence of 0 to 200 g of urea/kg of printing paste and the fibre material is intermediately dried and then steamed for 0.5 to 12 minutes, or a subsequent dry heat treatment is carried out.

All the abovementioned process variants are carried out, if appropriate, in the presence of 0.1–10 g of hexaphosphates/l of dye liquor or 0.5 to 10 g of hexaphosphates/kg of printing paste, and furthermore in the presence of 0.1 to 10 g of a naturally occurring or synthetic thickener/l of dye liquor or /kg of printing paste.

The "parts" given in the following examples are in all cases parts by weight.

EXAMPLE 1

100 Parts of a knitted cotton fabric are introduced into a dye liquor which contains 2 parts of the dyestuff I, 120 parts of sodium chloride, 2 parts of calcium chloride and 876 parts of water.

The bath is warmed from 20° to 120° C. in the course of 100 minutes and kept at 120° C. for 1 hour. The bath is then drained and the fabric is rinsed and soaped at the boil in the customary manner.

A clear red dyeing with good fastness properties is obtained.

Formula of the dyestuff I:

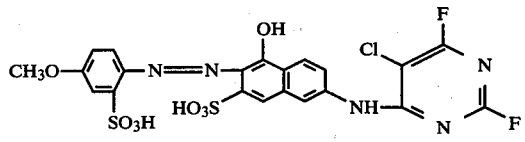

EXAMPLE 2

100 parts of a woven fabric consisting of 67 parts of polyester and 33 parts of cotton are impregnated with 80 parts of a liquor which consists of 20 parts of the dyestuff II, 20 parts of the dyestuff III, 30 parts of dicyandiamide, 2 parts of calcium formate and 928 parts of water.

The fabric is dried at 100° C. for 1 minute and then subjected to the thermosol process at 220° C. for 1 minute. After customary rinsing with cold and warm water, the fabric is soaped at the boil for 4 minutes, using an anionic washing agent which is customary in practice, in the presence of 1 g/l of hexaphosphate, and is dried.

A clear blue dyeing with good fastness properties is obtained.

Formula of the dyestuff II:

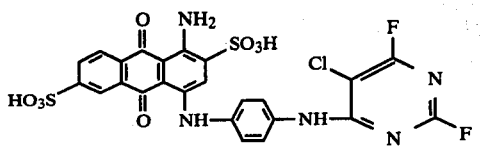

Formula of the dyestuff III:

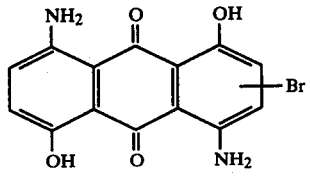

EXAMPLE 3

100 Parts of a woven fabric consisting of 50 parts of polyester and 50 parts of viscose staple are impregnated with 80 parts of a liquor which consists of 20 parts of the dyestuff IV, 20 parts of the dyestuff V, 2 parts of calcium acetate, 2 parts of polyacrylate and 956 parts of water.

The fabric is dried at 80° C. for 1 minute and subjected to the thermosol process at 220° C. for 1 minute.

After customary rinsing with cold and warm water and soaping at the boil, an orange dyeing with good fastness properties is obtained.

Formula of the dyestuff IV:

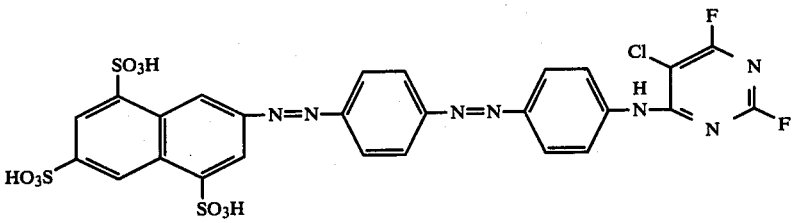

Formula of the dyestuff V:

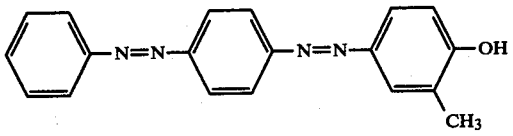

EXAMPLE 4

A cotton fabric is printed with an aqueous printing paste consisting of 40 parts of the dyestuff VI, 450 parts of 4% strength aqueous alginate thickener, 10 parts of pulverulent calcium carbonate, 150 parts of urea and 350 parts of water.

The fabric is dried at 120° C. for 1 minute and subjected to a dry heat treatment at 210° C. for 1 minute. Cold and warm rinsing and soaping at the boil for 10 minutes are then carried out in the customary manner.

A clear print with good fastness properties is obtained.

Formula of the dyestuff VI:

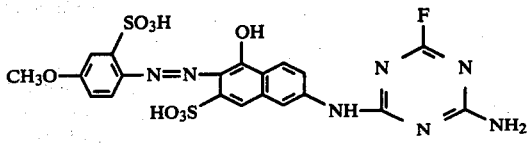

EXAMPLE 5

A mixed fabric consisting of 67 parts of polyester and 33 parts of cotton is printed with an aqueous printing paste consisting of 30 parts of the dyestuff VI, 20 parts of the dyestuff VII, 450 parts of 4% strength aqueous alginate thickener, 10 parts of light precipitated calcium carbonate, 50 parts of urea and 440 parts of water, and is dried at 120° C. for 1 minute and steamed at 180° C. in HT-steam for 15 minutes. After customary cold and warm rinsing, the fabric is soaped at the boil for 10 minutes using 2 g/l of an anionic washing agent which is customary in practice.

A red print with good fastness properties is obtained.

Formula of the dyestuff VI:

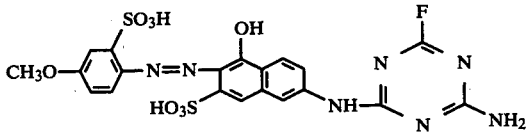

Formula of the dyestuff VII:

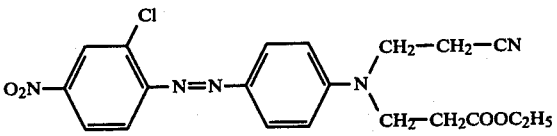

EXAMPLE 6

100 Parts of a mixed fabric consisting of 67 parts of polyester and 33 parts of cotton are impregnated with 60 parts of a liquor which consists of 40 parts of the dyestuff VIII, 20 parts of the dyestuff IX, 50 parts of polyglycol ether, 10 parts of pulverulent calcium carbonate and 880 parts of water.

The fabric is dried at 110° C. for 1 minute and then subjected to the thermosol process at 230° C. for 1 minute. After customary rinsing with cold and warm water, the fabric is soaped for 4 minutes, using an anionic washing agent which is customary in practice. It is then after-treated, for 4 minutes at the boiling point, with a liquor containing 1 g/l of 60% strength acetic acid and 1 g/l of hexaphosphate and is subjected to cold and warm rinsing and dried.

A deep blue dyeing with good fastness properties is obtained.

Formula of the dyestuff VIII:

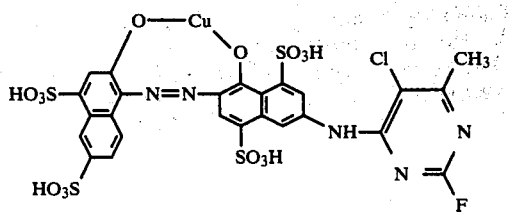

Formula of the dyestuff IX:

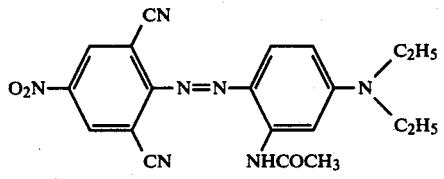

EXAMPLE 7

100 Parts of a woven fabric of 50 parts of polyester and 50 parts of mercerised cotton are treated, for 30 minutes, with a liquor which has been warmed to 130° C. and consists of 3 parts of the dyestuff X, 2 parts of the dyestuff XI, 150 parts of sodium sulphate, 3 parts of light precipitated calcium carbonate, 2 parts of sodium dinapthylmethanedisulphonate and 840 parts of water.

When the dyeing has ended, the liquor is drained off and the fabric is subjected to cold and warm rinsing and is soaped at the boil for 10 minutes, using an anionic washing agent which is customary in practice. The soaping liquor is drained off and the fabric is intermediately rinsed with warm water and brought to the boil with a fresh liquor containing 2 g/l of sodium hexaphosphate and 1 g/l of 60% strength acetic acid. It is then rinsed thoroughly. A clear turquoise blue dyeing with good fastness properties is obtained.

Formula of the dyestuff X:

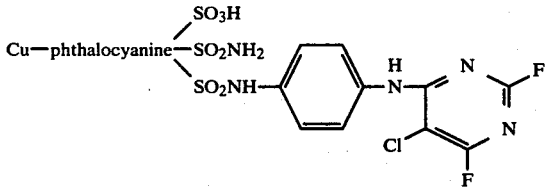

Formula of the dyestuff XI:

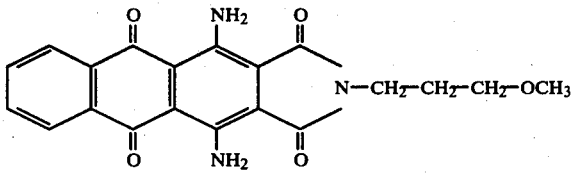

EXAMPLE 8

100 Parts of a mixed fabric of 80 parts of cotton and 20 parts of polyester are impregnated with 80 parts of a liquor which consists of 30 parts of the dyestuff X, 5 parts of the dyestuff XI, 80 parts of polyglycol ether, 10 parts of calcium stearate, 1 part of Na diethylhexyl phosphate and 874 parts of water.

The fabric is dried at 100° C. for 1 minute and subjected to the thermosol process at 225° C. for 1 minute. After customary rinsing, and soaping at the boil, a clear turquoise dyeing with good fastness properties is obtained.

Formula of the dyestuff X:

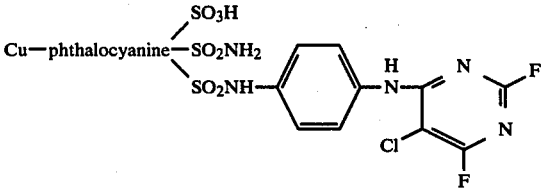

Formula of the formula XI:

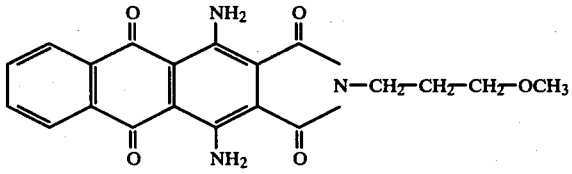

I claim:

1. Process for dyeing or printing fibre materials with the aid of reactive dyestuffs which split off fluoride ions, characterised in that neutral or acid dyebaths or printing pastes which contain, in addition to the reactive dyestuff and customary auxiliaries and solvents, one or more organic and/or inorganic calcium compounds are employed said calcium compounds being soluble in water or being sparingly soluble in water.

2. Process according to claim 1, characterised in that the dye liquor or printing paste has a pH value of 4–7.

3. Process according to claim 1 or 2, characterised in that the dyeing or printing process is carried out at a temperature of 20° to 240° C.

4. Process according to claim 1 or 2, characterised in that it is carried out by one of the following process variants (a) to (e):

(a) Exhaustion process in the presence of 10 to 200 g of NaCl or $Na_2SO_4$ per liter of dye liquor, (b) pad-thermofix process in the presence of 0 to 40 g of dicyandiamide and/or 0 to 200 g of urea per liter of dye liquor, (c) pad-steam process in the presence of 0 to 200 g of urea per liter of dye liquor, (d) direct printing with intermediate drying in the presence of 0 to 200 g of urea per kg of printing paste, and subsequent steaming, or (e) direct printing with intermediate drying in the presence of 0 to 200 g of urea, and subsequent dry heat treatment.

5. Process according to claims 1 or 2, characterised in that one liter of dye liquor or one kg of printing paste contains 0.1 to 10 kg of a hexaphosphate.

6. Process according to claims 1 or 2 characterised in that one liter of dye liquor or one kg of printing paste contains 0.1 to 10 g of a naturally occurring or synthetic thickener.

7. Process according to claims 1 or 2, characterised-in that a dyestuff which carries at least one difluorochloropyrimidinyl group is employed as the dyestuff which splits off fluoride ions.

8. Process according to claims 1 or 2, characterised in that a dyestuff which carries at least one monofluoropyrimidinyl group is employed as the dyestuff which splits off fluoride ions.

9. Process according to claims 1 or 2, characterised in that a dyestuff which carries at least one monofluorotriazinyl group is employed as the dyestuff which splits off fluoride ions.

10. Process according to claims 1 or 2, characterised in that a dyestuff which carries at least one tetrafluorocyclobutyl group is employed as the dyestuff which splits of fluoride ions.

11. Process according to claim 2 wherein the process is carried out in the presence of disperse dyestuffs.

* * * * *